United States Patent [19]

Wilger et al.

[11] Patent Number: 4,513,542

[45] Date of Patent: Apr. 30, 1985

[54] PORTABLE SURFACING MACHINE FOR BOILER MANHOLE

[75] Inventors: John F. Wilger, Honolulu; Gregory Nakano, Pearl City; William A. Berman, Honolulu, all of Hi.

[73] Assignee: The United States of America as represented by the Secretary of the Navy, Washington, D.C.

[21] Appl. No.: 542,314

[22] Filed: Oct. 14, 1983

[51] Int. Cl.[3] ..... B24B 19/08; B24B 19/26

[52] U.S. Cl. ..... 51/241 S; 51/241 B; 51/5 D; 51/127

[58] Field of Search ..... 51/241 R, 241 B, 241 S, 51/245, 241 A, 5 D, 120, 127

[56] References Cited

U.S. PATENT DOCUMENTS

| | | | |
|---|---|---|---|
| 1,799,109 | 3/1931 | Lyne | 51/241 B |
| 2,528,043 | 10/1950 | Dolmage | 51/245 |
| 3,141,365 | 7/1964 | Peters | 82/4 |
| 3,421,168 | 1/1969 | Bartel | 15/21 R |
| 3,623,270 | 11/1971 | Saab | 51/5 R |
| 3,848,371 | 11/1974 | Dillinger | 51/241 S |
| 4,109,635 | 8/1978 | Rossborough | 125/10 |

*Primary Examiner*—Roscoe V. Parker

*Attorney, Agent, or Firm*—R. F. Beers; E. F. Johnston

[57] ABSTRACT

A portable machine is provided for in-place grinding of an inside elliptical face of an elliptical boiler manhole access with a grinder which has a flat grinding surface. The boiler manhole access also has an outside elliptical face and a conforming elliptical edge therebetween. The machine includes a supporting structure which is adapted to be fixedly mounted in the manhole access and span the elliptical inside edge. A spindle is rotatably mounted on the support structure with its longitudinal axis substantially coextensive with the longitudinal axis of the manhole access. A sleeve is fixedly mounted to one end of the spindle in a direction perpendicular thereto, and an elongated hollow slide means is slidably mounted on the sleeve. The slide and the sleeve are in gas communication with one another so that when gas pressure is applied thereto the slide is outwardly spring biased from the spindle. The grinder is mounted to the slide with the grinding surface engageable with the inside elliptical face. A device is also mounted on the slide and responsive to the spring bias for following the contour of the elliptical edge of the manhole access when the spindle is rotated and correspondingly moving the slide to maintain the grinding surface in an opposed position with respect to the inside elliptical face at all times while the spindle is being rotated. When the spindle is rotated and gas pressure is applied, the above arrangement enables the maintenance of the grinding surface of the grinder in an engageable position with respect to the inside elliptical face.

18 Claims, 5 Drawing Figures

PORTABLE SURFACING MACHINE FOR BOILER MANHOLE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Many surface ships utilize marine boilers for propulsion. These boilers include steam and mud drums with manhole access hatches. During boiler inspection and/or repair these manhole hatches are opened to permit personnel to enter the drums. In order to enter through the manhole access a cover inside the drum is removed. This cover must be replaced after the work is accomplished. Manhole accesses are characteristically elliptical in shape and have an elliptical sealing surface in the interior of the drum for making the required seal with the cover. This interior elliptical sealing surface is subjected to extreme corrosive forces of steam in the steam drum and mineralized water in the mud drum. Consequently once the seal is broken by removing the cover the heavily corroded surface must be repaired to a smooth, flat machined finish so that the cover will adequately reseal the steam or mud drum. Submarines also have tanks with a boiler type manhole access hatch which are frequently opened for inspection and/or repair. These sealing surfaces, which are also elliptical, are subjected to extreme corrosion. These sealing surfaces must also be repaired to a smooth machined finish prior to closure of the tank.

The present practice of refurbishing elliptical sealing surfaces of manhole access hatches is to clad weld the surface to provide a material buildup therealong and then grind the surface smooth with a hand grinding machine. The buildup may also be accomplished by metal electroplating. Both of these methods are very time consuming and fall far short of restoring the sealing surface to the original machined surface. In some instances the access hatch is removed from the steam or mud drum or submarine tank by oxygen cutting so that the hatch can be sent to a machine shop for machining the sealing surface. Replacement of the access hatch involves critical rewelding which must pass very rigid inspection requirements. This whole process is very expensive and time consuming.

SUMMARY OF THE INVENTION

The present invention provides a portable machine for in-place grinding of the inside elliptical face of an elliptical boiler manhole access with a grinder which has a flat grinding surface. The present invention overcomes the prior art costly practices of in-place refurbishment and provides a much improved end result. The present portable machine for in-place grinding includes a support which is adapted to be fixedly mounted in the manhole access and span an elliptical inside edge. A spindle is rotatably mounted on the support with its longitudinal axis substantially coextensive with the longitudinal axis of the manhole access. A sleeve is fixedly mounted to one end of the spindle in a direction perpendicular thereto, and an elongated hollow slide is mounted on the sleeve. The slide and the sleeve are in gas communication with one another so that when air pressure is applied thereto the slide is outwardly spring biased from the spindle. The grinder is mounted to the slide with its flat grinding surface engageable with the inside elliptical face. A device, such as a roller, is mounted to the slide and is responsive to the spring bias for following the contour of the elliptical edge of the manhole access when the spindle is rotated. This arrangement will correspondingly move the slide to maintain the grinding surface in an opposed position with respect to the elliptical face at all times during rotation of the spindle. When the spindle is rotated and air pressure is applied, the above arrangement enables maintenance of the grinding surface of the grinder in an engageable position with respect to the inside elliptical face.

OBJECTS OF THE INVENTION

An object of the present invention is to overcome the problems associated with the prior practices of resurfacing an elliptical face of a boiler manhole.

Another object is to provide a portable machine for in-place grinding of a noncircular face of a doorway.

A further object is to provide an efficient and simple to use portable machine for in-place grinding of an inside elliptical face of an elliptical manhole access of a boiler.

Other objects, advantages and novel features of the invention will become apparent from the following detailed description of the invention when considered in conjunction with the accompanying drawings.

DESCRIPTION OF THE PREFERRED EMBODIMENT

Figure 1:
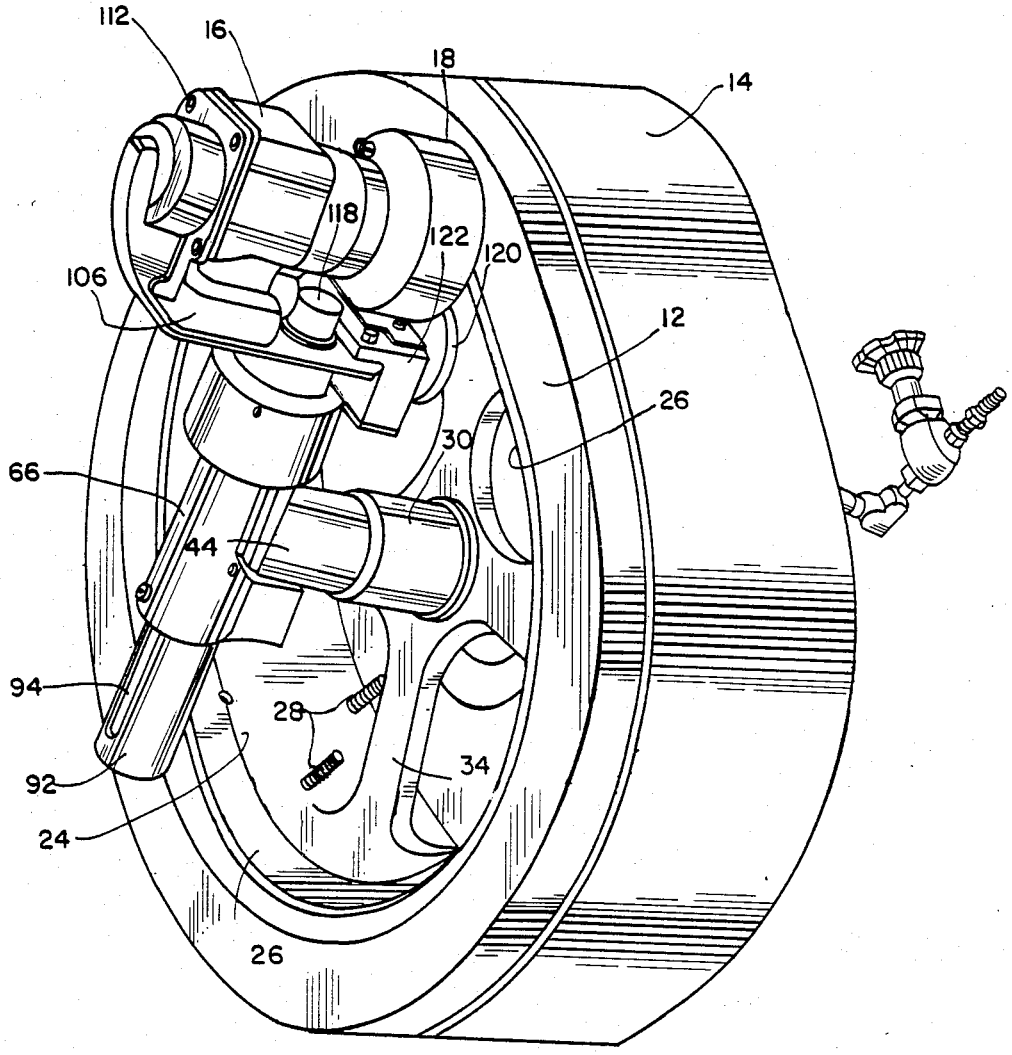
FIG. 1 is a perspective view of the present invention mounted in-place within a manhole access for grinding its elliptical face, the manhole access being removed from a boiler.
Figure 2:
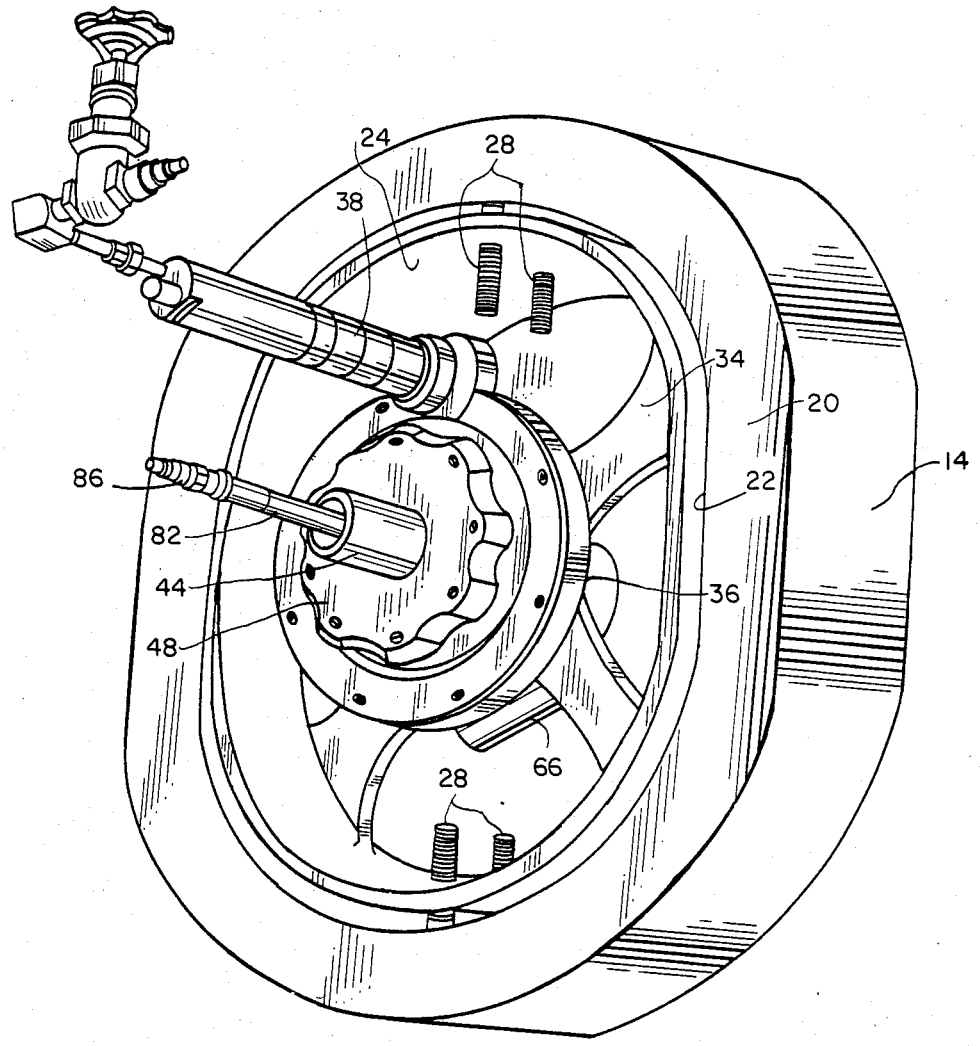
FIG. 2 is a perspective view of the back side of FIG. 1.

Referring now to the drawings wherein like reference numerals designate like or similar parts throughout the several views there is illustrated in FIG. 1 a portable machine 10 for in-place grinding of an inside elliptical face 12 of an elliptical boiler manhole access 14 with a grinder 16 which has a flat grinding surface 18. The boiler manhole access 14 is shown removed from a boiler (not shown) for illustration purposes. In order to enter the boiler a cover (not shown) is removed from the elliptical face 12 which is on the interior of the boiler. It is this face 12 that becomes extremely corroded due to high steam pressures. As shown in FIG. 2 the boiler manhole access 14 has an outside face 20 which may be elliptical. Between the elliptical faces 12 and 20 the boiler manhole access has an edge 22 within which the portable machine 10 is mounted. The edge 22 may also be elliptical.

Figure 3:
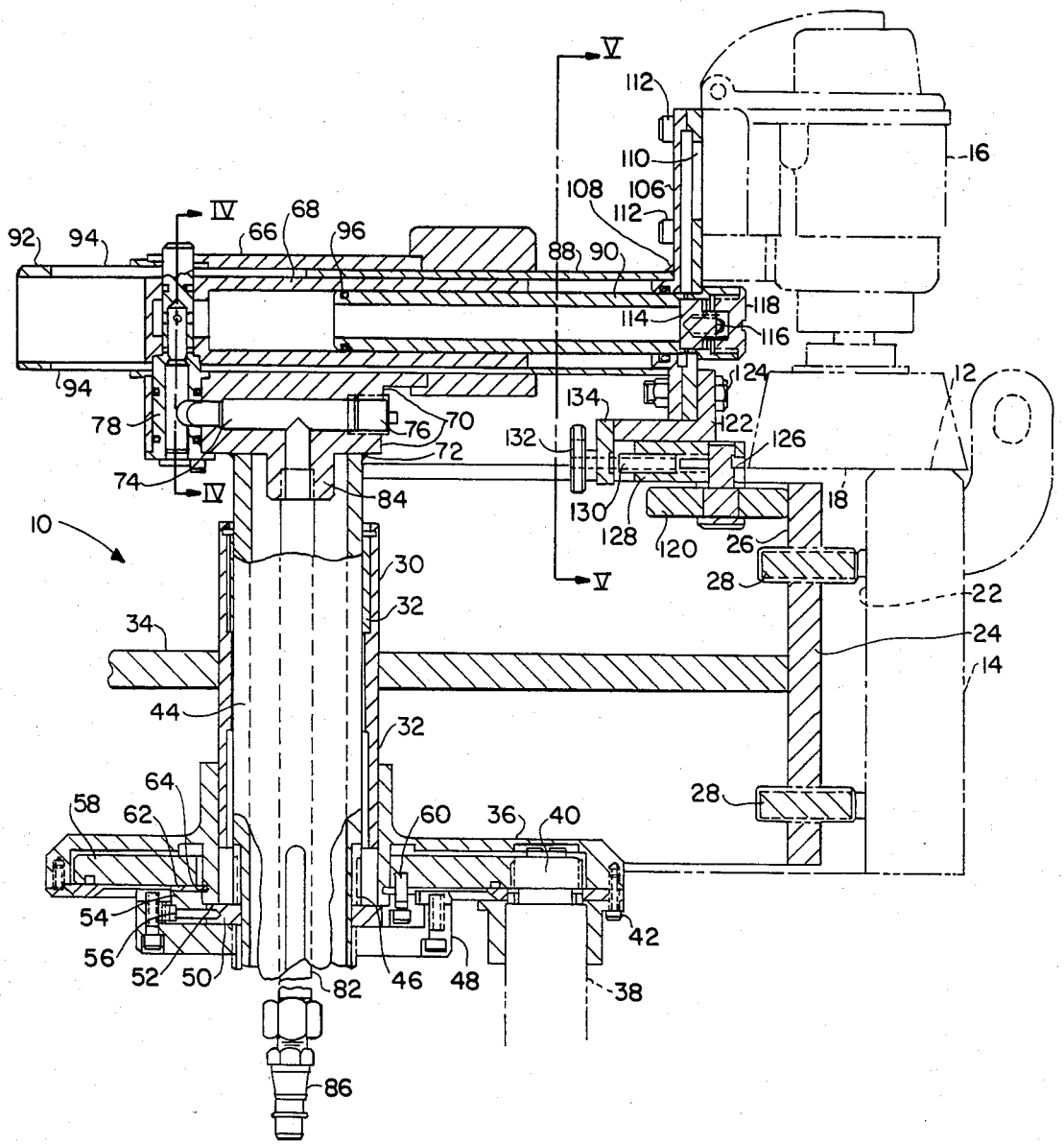
FIG. 3 is a longitudinal cross-sectional view of the present invention with portions shown in full.

As shown in FIG. 3, the portable machine 10 includes a support means which is adapted to be fixedly mounted in the manhole access 14 and span the elliptical edge 22. The support means may include an elliptical track 24 which conforms to the ellipse of the inside elliptical face 12, that is the inside surface 26 of the track 24 is concentric with a centerline between the outside and inside perimeters of the elliptical face 12. The track 26 may be centered within the manhole access 14 by a plurality of set screws 28. The support means may further include an elongated annular housing 30 which supports bearings 32, the housing being supported in an axially aligned relationship within the manhole access 14 by a plurality of radially extending webs 34 which interconnect the housing 30 to the track 24. The support means may still further include an annular gear housing 36 which is fixedly attached to the bearing housing 30 and which is adapted to mount an air motor 38 with its driving gear 40 being located within the housing 36. The air motor 38 may be mounted to the housing 36 by a bolt 42. All of the elements described heretofore remain fixed in place with the exception of the air motor gear 40 which rotates in place for a purpose to be described hereinafter.

A spindle 44 is rotatably mounted within the bearing housing 30 in slidable engagement with the bearings 32 and with its longitudinal axis substantially coextensive with the longitudinal axis of the manhole access 14. The spindle 44 is capable of both slidable rotation and axial movements with respect to the housing 30. The spindle 44 has a bottom threaded portion 46 which extends below the gear housing 36 and has threaded thereon a large cup-shaped nut 48. Mounted within the cup of the nut 48 are tabs 50 which slidably extend within longitudinal slots 52 in the spindle 44, the tabs being held in place by a ring assembly 54 and bolts 56. The ring assembly 54 is in turn connected to a ring gear 58 by bolts 60, the assembly 44 and the ring gear 58 having a retainer ring 62 located therebetween and slidable within an annular groove 64 of a downwardly extending portion of the gear housing 36. Accordingly, when the gear 40 of the air motor is rotated the ring gear 58 rotates which in turn rotates the tabs 50 within the slots 52 so as to cause rotation of the spindle 44. Further, the spindle 44 can be selectively moved in a longitudinal direction by rotating the nut 48. Rotation of the nut 48 operates on the threads 46 of the spindle to give the desired longitudinal movement, this movement being utilized for grinding purposes to be explained in more detail hereinafter.

A sleeve means is fixedly mounted to one end of the spindle in a direction perpendicular thereto. The sleeve means may include a pair of concentric tubes 66 and 68. The fixed attachment may be accomplished by providing the outside tube 66 with an enlarged side portion 70 which is welded to the top of the spindle at 72. This enlarged portion 70 of the tube may be provided with a passageway 74 which is closed at one end by a cap 76. Fixedly mounted in a perpendicular position to the enlarged tube portion 70 is a hollow cylinder 78 which is closed at opposite ends and is in gas communication with the passageway 74 and the interior of the interior tube 68. The hollow cylinder 78 may be fixedly attached to the enlarged portion 76 by welding at 80, as shown in FIG. 1. Gas pressure, such as pressurized air, may be introduced into the aforementioned cavities by a pipe 82 which extends axially through the spindle 44 terminating with a press fit within an annular flange 84 of the enlarged portion 70. The bottom end of the pipe 82 may be provided with a fitting 86 which is capable of receiving a fitting (not shown) of a pressurized air line (not shown). The purposes of this pressurized air will be explained in detail hereinafter.

Figure 4:
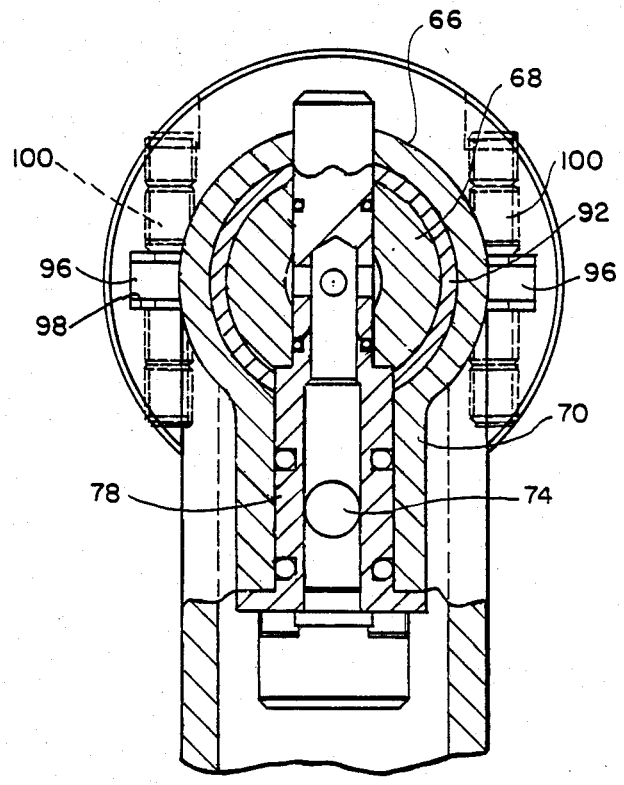
FIG. 4 is a view taken along plane IV—IV of FIG. 3.
Figure 5:
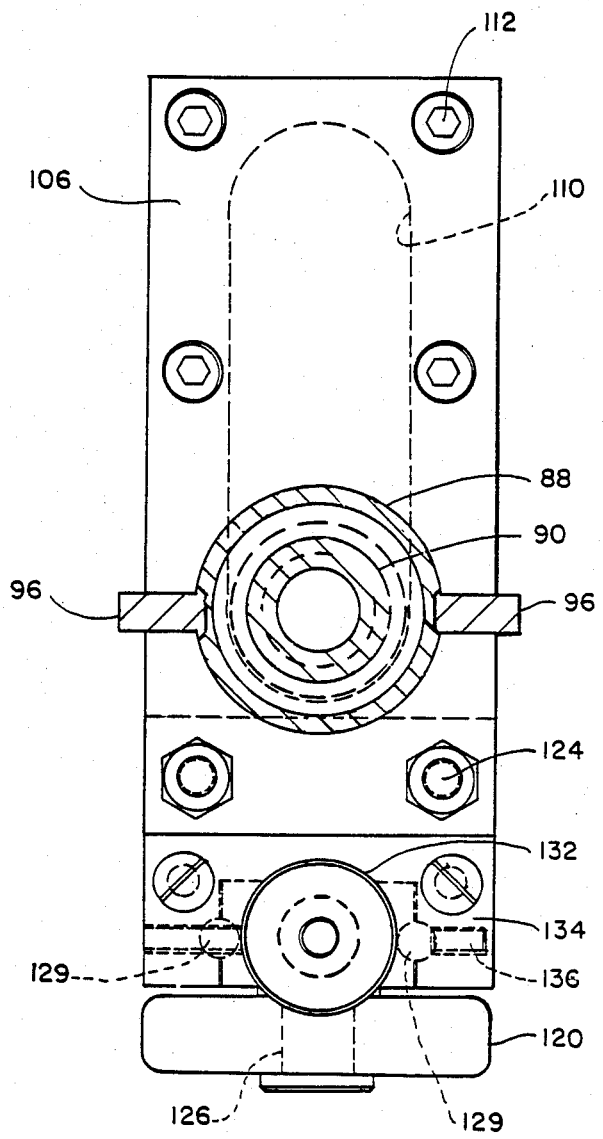
FIG. 5 is a view taken along plane V—V of FIG. 3.

An elongated hollow slide means is slidably mounted on the sleeve means, the slide means and the sleeve means being in gas communication with one another so that when gas pressure is applied thereto the slide means is outwardly spring biased from the spindle 44. The hollow slide means may include a pair of concentric tubes 88 and 90, the outer tube 88 being slidably mounted between the concentric tubes 66 and 68 of the sleeve means and the inner concentric tube 90 being slidably mounted within the inner concentric tube 68 of the sleeve means. The outer concentric tube 88 of the slide means has a tail portion 92 which extends beyond the concentric tubes 66 and 68 of the sleeve means. This tail portion has oppositely positioned slots 94 which are sized to receive the hollow cylinder 78 so that the slide means can slide past this hollow cylinder without any interruption over a set distance of travel. As shown in FIGS. 1, 4 and 5 the outer tube 88 of the slide means may be provided with a pair of oppositely positioned keys 96 which ride within a pair of oppositely positioned slots 98 within the outer tube 66 of the sleeve means. Snug slidable engagement may be maintained between these components by nylon set screws 100 which are threaded into an enlarged portion of the tube 66 in engagement with the tops and bottoms of the key 96. This enables a smooth and firm slidable transition of the slide means 88 and 90 with respect to the sleeve means 66 and 68.

Means are provided for mounting the grinder 16, which may be air driven, to the slide means 88 and 90 with the grinding surface 18 of the grinder engageable with the inside elliptical face 12 of the manhole access 14. The grinder mounting means may include a hollow flange 106 which is connected to an outer end of the slide means 88 and 90 by any suitable means such as welding at 108. The hollow flange 106 is adapted for gas communication with the interior of the tube 90 of the slide means, and has an aperture 110 for introducing gas pressure into the air driven grinder 16. The grinder 16 may be fixed to the hollow flange by bolts 112. Valve means, such as valve 114, is provided for opening gas communication between the tube 90 of the slide means and the flange 106 only when gas pressure in the tube 90 has exceeded a predetermined amount. This is accomplished by a spring loaded plunger 116 which is located within a cap assembly 118. Accordingly, when gas pressure has exceeded the spring pressure of the plunger 116 the valve 114 moves to the right to allow gas to enter the air-driven motor 16 to rotate the grinding face 18. The grinding face 18 makes grinding engagement with the elliptical face 12 by selective rotation of the nut 48.

As shown in FIG. 3, means are mounted to the slide means and are responsive to the spring bias of the slide means 88 and 90 for following the contour of the elliptical face 12 of the manhole access when the spindle 44 is rotated, thus moving or reciprocating the slide means 88 and 90 to maintain the grinding surface 18 in an opposed position with respect to the elliptical face 12 at all times while the spindle 44 is being rotated. This means may include a roller 120 which is mounted to the bottom of the flange 106 by a bracket 122 and a bolt and nut combination 124. A roller shaft 126 may be transversely mounted within a tubular hub 128. A bolt 130 with a knurled head 132 may be threaded into the tubular hub 128 and may be slidably mounted for rotation in a flange 134 which is fixedly connected to the bracket 122. With this arrangement the knurled head 132 may be selectively rotated to radially position the roller 120 against the inside elliptical edge 26 of the track 24 for radially positioning the grinding surface 104 with respect to the elliptical face 12. When the spindle 44 is rotated the roller 120 follows the contour of the track 24 to maintain the grinding surface 18 in an opposed position with respect to the elliptical face 12.

Various O-rings and sealing surfaces are shown in FIG. 3 for providing the necessary sealing of the pressurized gas so as to operate all of the aforementioned components as described.

OPERATION OF THE INVENTION

In the operation of the invention, the portable machine is placed within a manhole access 14 with the manhole access 14 in place within a boiler drum of a ship or similar power plant. With the grinder 16 on the inside end of the boiler drum the set screws 28 are selectively adjusted until the axis of the elliptical track is coaxial with the axis of the inside edge 22 of the manhole access 14. A pressure line (not shown) is connected to the fitting 86 and a slight amount of pressure is applied until the slide means 88 and 90 is outwardly spring biased to engage the roller 120 with the inside elliptical surface 26 of the track 24. The knurled head 132 is then selectively adjusted until the grinding surface 18 of the grinder 16 is positioned over the elliptical face 12 of the manhole access 14. The nut 48 is then selectively adjusted until the grinding face 18 is slightly spaced from the elliptical face 12. Additional air pressure is then applied to open the valve 114 causing pressurized air to operate the grinder 16 and rotate the grinding face 18. The air motor 38 is then activated to turn the gear 40 and the ring gear 58 to cause the spindle 44 and the entire assembly attached thereto including the grinder 16 and the grinding face 18 to move along the elliptical face 12. The nut 48 is then selectively adjusted to bring the grinding face 18 of the grinder into grinding engagement with the elliptical face 12 to perform the desired grinding operation of the elliptical face 12. The nut 48 is continued in its adjustment until the grinding face 18 has ground the elliptical face 12 smooth, after which time operation of the air motor 38 and introduction of pressurized air through the pipe 82 are terminated. The procedure is then reversed for removing the portable machine from the manhole access and the elliptical face 12 is readied for installation of the manhole cover (not shown).

It should be understood that the present invention can be utilized for grinding any noncircular face of any opening resembling a doorway. While there are other apparatuses for refurbishing doorway faces which are circular, it should also be understood that the present invention can be also utilized for refurbishing such circular faces.

Obviously many modifications and variations of the present invention are possible in the light of the above teachings. It is therefore to be understood that within the scope of the appended claims the invention may be practiced otherwise than as specifically described.

What is claimed is:

1. A portable machine for in-place grinding of a noncircular face of a doorway, with a grinder which has a flat grinding surface, the doorway also having an opposite face and an edge therebetween, said machine comprising:

support means which is adapted to be fixedly mounted in the doorway and span the doorway edge;

a spindle rotatably mounted on the support means with its longitudinal axis substantially coextensive with the longitudinal axis of the doorway;

means mounted to the spindle for reciprocating the grinder in a direction normal to the spindle with the grinding surface maintained in a substantially parallel position with respect to the doorway face;

means for spring biasing the reciprocating means and grinder away from said spindle;

means mounted to the reciprocating means and responsive to the spring biasing means for following the noncircular contour of the doorway face when the spindle is rotated and correspondingly moving the reciprocating means to maintain the grinding surface in an opposed position with respect to the doorway face at all times while the spindle is being rotated, whereby, upon mounting the grinder and rotating the spindle, the grinding surface of the grinder is engageable with the doorway face.

2. A portable machine as claimed in claim 1 including:

the spindle also being slidably mounted to the support means for axial movement; and nut means rotatably mounted to the support means and threadably engaging the spindle for axially moving the spindle when the nut is rotated, whereby the grinding surface of the grinder can be brought into grinding engagement with the face of the manhole access.

3. A portable machine as claimed in claim 1 wherein the support means includes:

a track having a noncircular inside surface which conforms to the contour of the noncircular face of the doorway; and means for centering the track in the doorway.

4. A portable machine as claimed in claim 3 including:

the following means engaging said track for following the contour of the doorway face.

5. A portable machine as claimed in claim 4 including:

the following means engaging the track with a roller.

6. A portable machine as claimed in claim 1 wherein the reciprocating means includes:

sleeve means fixed to one end of the spindle in a perpendicular direction thereto; and slide means reciprocally mounted to the sleeve means.

7. A portable machine as claimed in claim 6 wherein the spring biasing means includes:

the slide means being hollow and in gas communication with the sleeve means; and means for applying gas pressure to the sleeve and slide means.

8. A portable machine as claimed in claim 7 including:

a hollow flange connected at an outer end of the slide means and being in gas communication therewith;

the hollow flange adapted to support and be in gas communication with a gas driven grinder; and valve means for opening gas communication between the slide means and the flange means only when gas pressure in the slide means has exceeded a predetermined amount.

9. A portable machine as claimed in claim 8 including:

the sleeve means and the slide means each including a pair of concentric tubes;

the concentric tubes of the slide means being mounted within the concentric tubes of the sleeve means;

the innermost tube of the slide means being in gas communication with the innermost tube of the sleeve means; and a pipe extending axially through the spindle means and in gas communication at an inner end with the sleeve and slide means and adapted at an outer end with a fitting for connection to the means for applying gas pressure.

10. A portable machine as claimed in claim 9 including:

means mounted on the support means for rotating the spindle.

11. A portable machine for in-place grinding of an inside elliptical face of an elliptical boiler manhole access with a grinder which has a flat grinding surface, the boiler manhole access also having an outside face and an edge therebetween, said machine comprising:

support means which is adapted to be fixedly mounted in the manhole access and span the inside edge;

a spindle rotatably mounted on the support means with its longitudinal axis substantially coextensive with the longitudinal axis of the manhole access;

sleeve means fixedly mounted to one end of the spindle in a direction perpendicular thereto;

an elongated hollow slide means slidably mounted on the sleeve means, the slide means and the sleeve means being in gas communication with one another so that when gas pressure is applied thereto the slide means is outwardly spring biased from the spindle;

means for mounting the grinder to the slide means with the grinding surface engageable with the inside elliptical face; and means mounted to the slide means and responsive to the spring bias for following the contour of the inside elliptical face of the manhole access when the spindle is rotated and correspondingly moving the slide means to maintain the grinding surface in an opposed position with respect to the elliptical face at all times while the spindle is being rotated;

whereby, when the spindle is rotated and gas pressure is applied, the follower means is biased towards the edge and enables maintenance of the grinding surface of the grinder in an engageable position with respect to said inside elliptical face.

12. A portable machine as claimed in claim 11 including:

the spindle also being slidably mounted to the support means for axial movement; and nut means rotatably mounted to the support means and threadably engaging the spindle for axially moving the spindle when the nut is rotated, whereby the grinding surface of the grinder can be brought into grinding engagement with the inside elliptical face of the manhole access.

13. A portable machine as claimed in claim 12 including:

a hollow flange connected at an outer end of the slide means and being in gas communication therewith;

the hollow flange being adapted to support and be in gas communication with a gas driven grinder; and valve means for opening gas communication between the slide means and the flange means only when gas pressure in the slide means has exceeded a predetermined amount.

14. A portable machine as claimed in claim 13 including:

the sleeve means and the slide means each including a pair of concentric tubes;

the concentric tubes of the slide means being mounted within the concentric tubes of the sleeve means;

the innermost tube of the slide means being in gas communication with the innermost tube of the sleeve means; and a pipe extending axially through the spindle means and in gas communication at an inner end with the sleeve and slide means and adapted at an outer end with a fitting for connection to a means for applying gas pressure.

15. A portable machine as claimed in claim 14 wherein the support means includes:

a track having an elliptical inside surface which conforms to the contour of the inside elliptical face of the manhole access; and means for centering the track in the manhole access.

16. A portable machine as claimed in claim 15 including:

the following means being mounted to the flange means; and the following means engaging the inside surface of said track for following the contour of the inside elliptical face of the manhole access.

17. A portable machine as claimed in claim 16 including:

the following means engaging the track with a roller.

18. A portable machine as claimed in claim 17 wherein the following means includes:

means for selectively adjusting the radial position of the roller.

* * * * *